US008661859B2

(12) United States Patent
Choi

(10) Patent No.: US 8,661,859 B2
(45) Date of Patent: Mar. 4, 2014

(54) DOOR LOCK DEVICE OF DRUM WASHING MACHINE AND WASHING MACHINE HAVING THE SAME

(75) Inventor: Han Kyu Choi, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 947 days.

(21) Appl. No.: 12/662,552

(22) Filed: Apr. 22, 2010

(65) Prior Publication Data

US 2010/0283362 A1 Nov. 11, 2010

(30) Foreign Application Priority Data

May 8, 2009 (KR) ..... 10-2009-0040317

(51) Int. Cl.
*D06F 37/28* (2006.01)
*D06F 39/14* (2006.01)

(52) U.S. Cl.
USPC ..... 68/12.26; 68/196

(58) Field of Classification Search
USPC ..... 68/3 R, 12.26, 196; 292/DIG. 69
See application file for complete search history.

(56) References Cited

U.S. PATENT DOCUMENTS 4,009,305 A * 2/1977 Fujimaki et al. ..... 427/399
4,179,907 A * 12/1979 Schantz ..... 68/12.26
4,193,619 A * 3/1980 Jerila ..... 292/168
5,042,171 A * 8/1991 Obata et al. ..... 34/604
6,634,684 B2 * 10/2003 Spiessl ..... 292/341.16
7,032,936 B2 * 4/2006 Promutico ..... 292/95
7,537,251 B1 * 5/2009 Profita ..... 292/339
8,006,521 B2 * 8/2011 Rocchitelli ..... 68/12.26
8,132,432 B2 * 3/2012 Lim et al. ..... 68/12.02
8,256,249 B2 * 9/2012 Lim et al. ..... 68/212
2004/0083769 A1 5/2004 Kim et al.
2004/0244435 A1 * 12/2004 Kim ..... 68/12.26

FOREIGN PATENT DOCUMENTS

EP 1741378 1/2004
GB 2107383 4/1983
JP 04076177 A * 3/1992 ..... E05C 17/22
KR 1020090002342 1/2009

OTHER PUBLICATIONS

European Search Report for corresponding European Patent Application No. 10160586.3 dated Sep. 23, 2010 (in English).

* cited by examiner

*Primary Examiner* — Joseph L Perrin
(74) *Attorney, Agent, or Firm* — Staas & Halsey LLP

(57) ABSTRACT

Disclosed herein are a door lock device of a drum washing machine and a drum washing machine having the same, a door of which is opened by force of a predetermined magnitude or greater. The door opening is accomplished by providing a door lever of the door lock device with a bent portion. The bent portion formed at the door lever creates a predetermined angle X° between a contact point between a holding protrusion of the door lever and a raised portion of a body of the washing machine, a center point of a door lever shaft, and a contact point between a handle contact portion of the door lever and a door handle, allowing the door to be opened upon receiving force of a predetermined magnitude or greater.

20 Claims, 6 Drawing Sheets

DOOR LOCK DEVICE OF DRUM WASHING MACHINE AND WASHING MACHINE HAVING THE SAME

CROSS-REFERENCE TO RELATED APPLICATIONS

This application claims the benefit of Korean Patent Application No. 2009-0040317, filed on May 8, 2009 in the Korean Intellectual Property Office, the disclosure of which is incorporated herein by reference.

BACKGROUND

1. Field

Embodiments of the present invention relate to a drum washing machine, a door of which is opened by force of a predetermined magnitude or greater.

2. Description of the Related Art

Generally, a drum washing machine washes laundry received in a rotating tub as the laundry repeatedly rises and falls due to rotation of the rotating tub. Such a drum washing machine includes a body having a door to be opened or closed, a washtub fixedly installed in the body, a rotating tub rotatably installed in the washtub, and water supply/drain devices.

The body is formed in a front surface thereof with a laundry input opening, to allow a user to put laundry into the rotating tub. The door is pivotally coupled to the front surface of the body, to open or close the laundry input opening.

A door lock device is coupled to both an inner surface of the door and the body and locks the door to the body. The door lock device includes a door lever coupled to the door and configured to be caught by a door switch of the body. When the door is pivoted to the laundry input opening, the door lever is caught by the door switch, allowing the door to come into close contact with the front surface of the body while closing the laundry input opening.

Over time, the size of the drum washing machines has increased, to wash a greater amount of laundry at once. That is, the rotating tub, in which laundry is received, has been manufactured to a greater size.

However, the rotating tub of the greater size may often cause an accident when the door is unexpectedly closed after a child enters the rotating tub. For this reason, it may be necessary to provide a washing machine designed to allow a child to escape by himself by opening a door from the inside.

SUMMARY

Therefore, it is an aspect of the present invention to provide a washing machine to prevent an accident from occurring therein.

Additional aspects of the invention will be set forth in part in the description which follows and, in part, will be apparent from the description, or may be learned by practice of the invention.

The foregoing and/or other aspects of the present invention are achieved by providing a drum washing machine including a body having an opening, a door to open or close the opening, a door switch to lock the door, and a door lock device coupled to the door switch, the door lock device including a door lever pivotally installed to the door and selectively inserted into or separated from the door switch, and the door lever including a bent portion formed at a position thereof to enable release of coupling between the door and the body by force of a predetermined magnitude or greater applied to the door.

The door lever may include a hook portion to be caught by or released from a raised portion, a rotating portion rotatably coupled to the door and having a rotation center, the bent portion, and a connecting portion to connect the hook portion and rotating portion to each other.

The connecting portion may include a first connecting portion linearly extending from the hook portion to the bent portion, and a second connecting portion extending obliquely from the bent portion to the rotating portion.

The door lock device may further include a door handle for the user to grip, and the door lever may include a handle contact portion protruding from the rotating portion to come into contact with the door handle.

The body may include the raised portion, by or from which the hook portion is caught or released, the hook portion may include a holding protrusion protruding from an end thereof to be caught by the raised portion, and an angle defined between a contact point between the holding protrusion and the raised portion, the rotation center of the rotating portion, and a contact point between the handle contact portion and the door handle may be in a range of about 35° to about 75°.

The door lever may contain at least one of die-cast zinc material and die-cast aluminum material. The door lever may be made of a mixture of PolyOxyMethylene (POM) resin and glass fiber. A concentration of the glass fiber in the mixture may be in a range of about 10% to about 30%.

The foregoing and/or other aspects of the present invention are also achieved by providing a door lock device of a drum washing machine including a door lever inserted into a body of the drum washing machine and a door handle in contact with the door lever, the door lever including a hook portion selectively caught by or released from the body, a rotating portion rotatably coupled to the door and having a rotation center, and a handle contact portion coming into contact with the door handle, and an angle defined between an end of the hook portion, the rotation center of the rotating portion, and a contact point between the handle contact portion and the door handle is between about 35° to about 75°.

The door lever may include a connecting portion to connect the hook portion and rotating portion to each other, and the connecting portion includes a bent portion.

The connecting portion may include a first connecting portion linearly extending from the hook portion to the bent portion, and a second connecting portion extending obliquely from the bent portion to the rotating portion.

The door lever may contain at least one of die-cast zinc material and die-cast aluminum material. The door lever may be made of a mixture of PolyOxyMethylene (POM) resin and glass fiber. A concentration of the glass fiber in the mixture may be in a range of about 10% to about 30%.

The foregoing and/or other aspects of the present invention are also achieved by providing a door lock device of a drum washing machine including a door lever to be inserted into a body of the drum washing machine and a door handle in contact with the door lever, the door lever including a hook portion selectively caught by or released from the body, a rotating portion rotatably coupled to the door and having a rotation center, and a connecting portion to connect the hook portion and rotating portion to each other, and an end of the hook portion and the rotation center of the rotating portion being spaced apart from each other at opposite sides of the connecting portion, to enable release of coupling between the door and the body by force of a predetermined magnitude or greater applied to the door.

The connecting portion may include a center bent portion, a first connecting portion extending from the hook portion to the bent portion, and a second connecting portion extending from the bent portion to the rotating portion.

The door lever may contain at least one of die-cast zinc material and die-cast aluminum material.

The foregoing and/or other aspects of the present invention are also achieved by providing a door lock device of a drum washing machine including a door lever to be inserted into a body of the drum washing machine and a door handle in contact with the door lever, the door lever including a hook portion selectively caught by or released from the body, a rotating portion rotatably coupled to the door and having a rotation center, and a connecting portion to connect the hook portion and rotating portion to each other, and an end of the hook portion and the rotation center of the rotating portion being spaced apart from each other with a horizontal distance therebetween, to convert force applied to the door into force for release of coupling between the door and the body.

The connecting portion may include a center bent portion, a first connecting portion extending from the hook portion to the bent portion, and a second connecting portion extending from the bent portion to the rotating portion.

The door lever may contain at least one of die-cast zinc material and die-cast aluminum material.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION OF EMBODIMENTS

Figure 1:
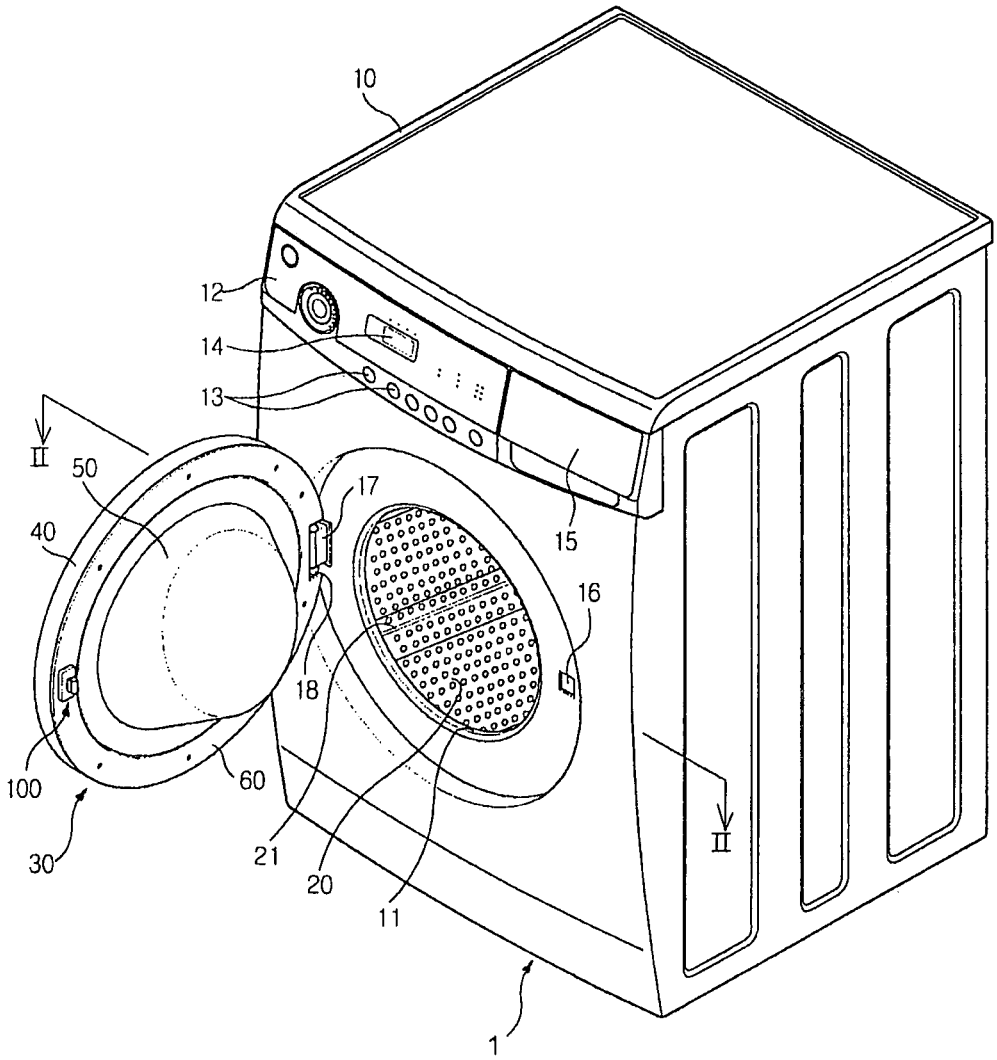
FIG. 1 is a perspective view of a drum washing machine according to an embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

Figure 2:
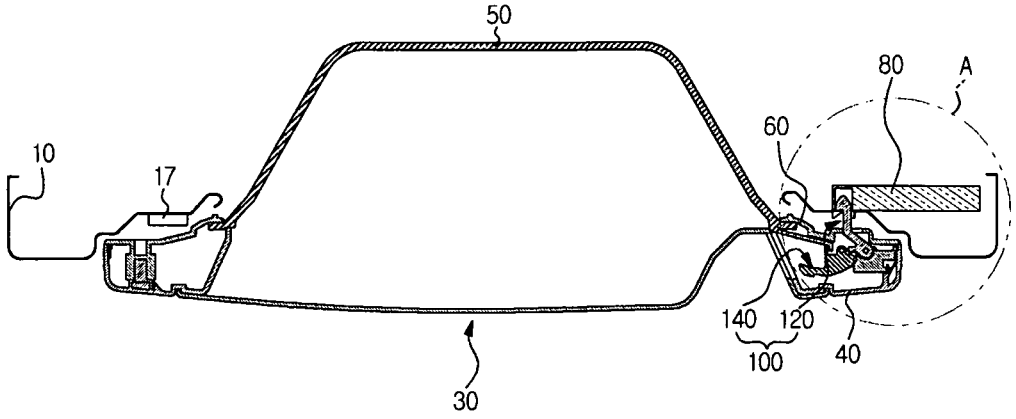
FIG. 2 is a sectional view taken along line II-II in a closed state of a door in FIG. 1.
Figure 3:
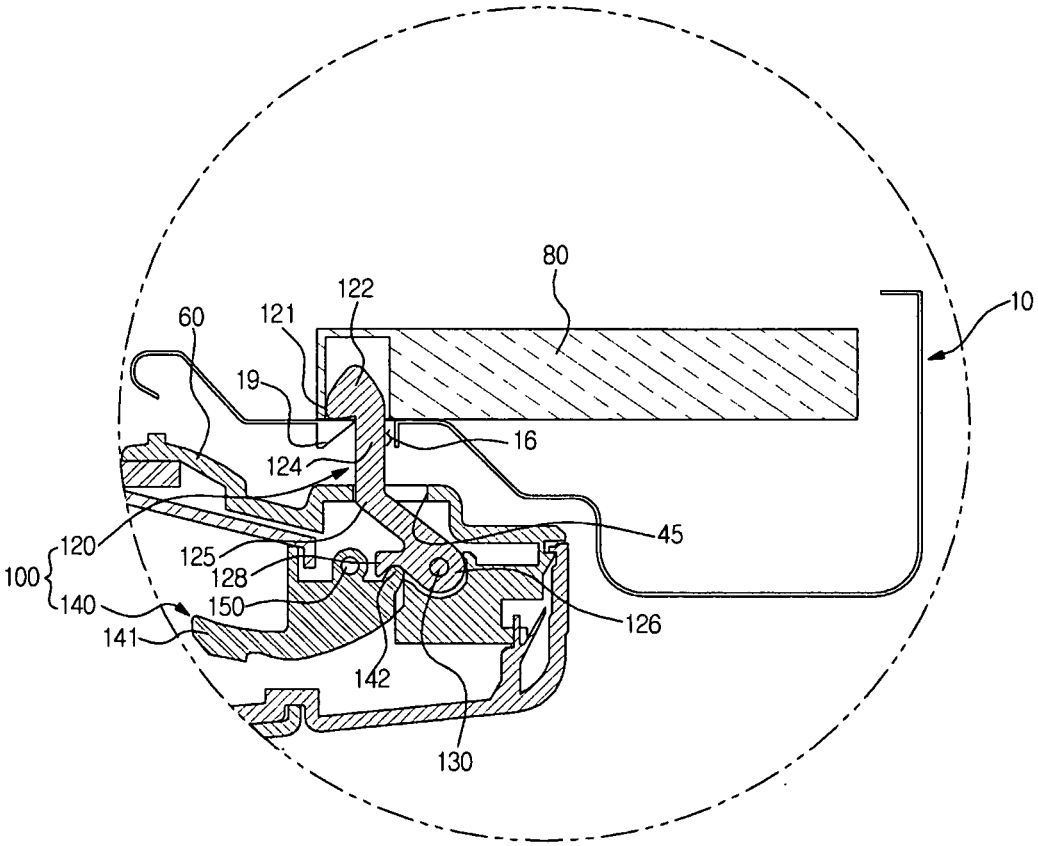
FIG. 3 is an enlarged sectional view of the portion "A" of FIG. 2.
Figure 4:
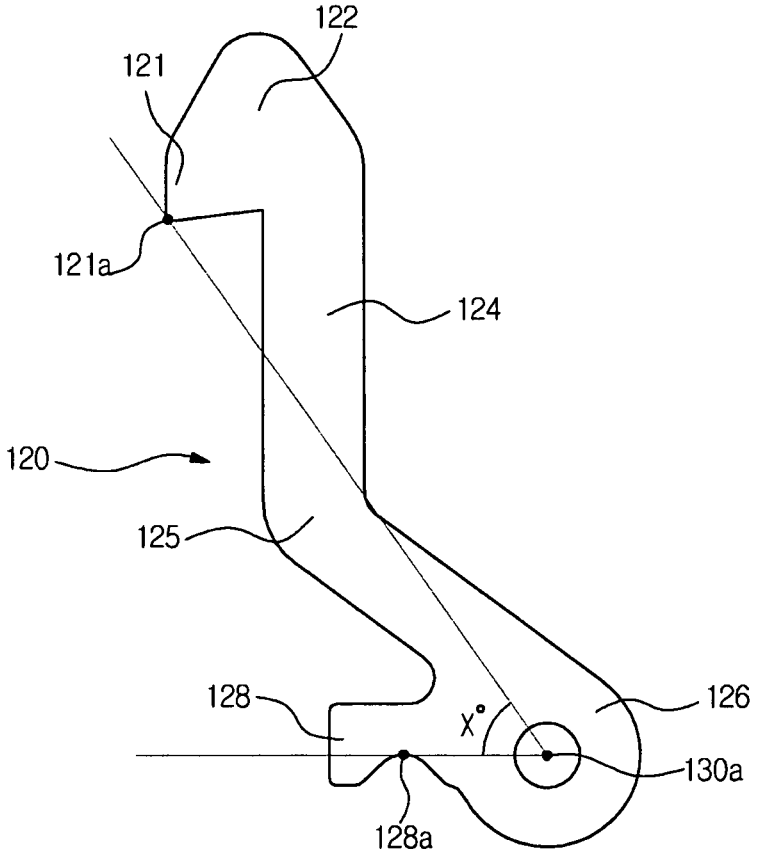
FIG. 4 is a front view of a door lever.

FIG. 1 is a perspective view of a drum washing machine according to an embodiment of the present invention, FIG. 2 is a sectional view taken along the line II-II in a closed state of a door in FIG. 1, FIG. 3 is an enlarged sectional view of the portion "A" of FIG. 2, and FIG. 4 is a front view of a door lever.

Referring to FIGS. 1 to 3, the drum washing machine 1 includes a body 10 having a laundry input opening 11, a rotating tub 20 rotatably installed in the body 10, and a door 30 coupled to a front surface of the body 10 and used to open or close the laundry input opening 11.

A control panel 12 for user manipulation is installed on an upper portion of the front surface of the body 10. The control panel 12 includes a variety of operating buttons 13 and a display 14. A detergent supply device 15 is provided at one side of the control panel 12 and is used to supply detergent into the rotating tub 20.

The rotating tub 20 is perforated with a plurality of holes. Lifters 21 are arranged on an inner peripheral surface of the rotating tub 20 and are used to raise laundry.

An insertion recess 16, into which a door lock device 100 that will be described hereinafter is inserted, is formed at one side of the laundry input opening 11 of the body 10. A door switch 80 is mounted inside the insertion recess 16. The door switch 80 is electrically connected to a controller (not shown) of the drum washing machine 1 and serves to constrain the coupling of the door lock device 100. That is, the door switch 80 is coupled to the door lock device 100 or releases the coupling of the door lock device 100 based on electric signals of the controller.

The door 30 includes a door cover 40 hinged to the front surface of the body 10, a door glass 50 coupled to the door cover 40, and a door glass holder 60 to couple the door glass 50 to the door cover 40. The door lever 120 passes through a hole 45 in the door glass holder 60.

The door cover 40 and door glass holder 60 have a centrally-opened annular shape to couple the transparent door glass 50. The door cover 40 and door glass holder 60 are coupled to each other by a plurality of fastening screws and in turn, a rim of the door glass 50 is press-fitted between the door cover 40 and the door glass holder 60. Thereby, the door cover 40, door glass 50, and door glass holder 60 are integrally coupled with one another.

The door cover 40 is coupled to a hinge shaft 18 of a hinge device 17 that is installed at a lateral position of the front surface of the body 10 and thus, is pivotable about the hinge shaft 18.

The door lock device 100 is located at one side of the door glass holder 60. The door lock device 100 includes a door lever 120, and a door handle 140 for the user to grip. The door lever 120 is pivotable inside the door cover 40 and is configured to be inserted into or separated from the door switch 80.

The door lever 120 is coupled to the door 30 via a door lever shaft 130 inside the door cover 40 and is pivotally rotated within a predetermined range about the door lever shaft 130. As shown in FIG. 4, the door lever 120 includes a hook portion 122 configured to be caught by or released from a raised portion 19 of the body 10, a rotating portion 126 having a center hole through which the door lever shaft 130 penetrates to enable pivotal rotation of the door lever 120 inside the door cover 40, a connecting portion 124 extending between the hook portion 122 and the rotating portion 126, and a handle contact portion 128 protruding from the rotating portion 126 to come into contact with the door handle 140.

The hook portion 122 has a holding protrusion 121 configured to be caught by the raised portion 19 formed at one side of the insertion recess 16 of the body 10. The holding protrusion 121 protrudes from an end of the hook portion 122.

The connecting portion 124 includes a center bent portion 125. The center bent portion 125 divides the connecting portion 124 into two portions having a predetermined angle therebetween. That is, the connecting portion 124 extends linearly from the hook portion 122 to the bent portion 125, but extends obliquely from the bent portion 125 to the rotating portion 126.

The door lever shaft 130 is fastened through the center hole of the rotating portion 126, and the rotating portion 126 is rotated about the door lever shaft 130. A spring (not shown) is installed at one side of the rotating portion 126 and is used to keep the door lever 120 in contact with the door handle 140 while elastically supporting the door lever 120.

The handle contact portion 128 protruding from the rotating portion 126 is adapted to come into contact with the door handle 140 and serves to transmit the user's push force applied to the door handle 140 toward the door lever 120.

In the above-described configuration of the door lever 120, as shown in FIG. 4, a predetermined angle X° is defined between a tip end 121*a* of the holding protrusion 121, a center point 130*a* of the door lever shaft 130, and a contact point 128*a* between the handle contact portion 128 and door handle 140. As will be described hereinafter, due to the angle X°, the door 30 may be opened by force of a predetermined magnitude or more applied from inside the door 30.

Describing the above-described configuration in another manner, the holding protrusion 121 and the center point 130*a* of the door lever shaft 130 are spaced apart from each other at opposite sides on the basis of the connecting portion 124.

Also, the holding protrusion 121 and the center point 130*a* of the door lever shaft 130 are spaced apart from each other with a horizontal distance therebetween.

In the embodiment of the present invention, the door lever 120 is made of die-cast zinc material. The die-cast zinc material provides appropriate frictional force to allow the door 30 to be opened by force of a predetermined magnitude or greater applied from inside the door 30.

In an alternative embodiment, the door lever 120 may be made of die-cast aluminum material. The die-cast aluminum material also provides appropriate frictional force to allow the door 30 to be opened by force of a predetermined magnitude or more applied from inside the door 30.

In another alternative embodiment, the door lever 120 may be made of a mixture of PolyOxyMethylene (POM) resin and glass fiber. In this case, an appropriate concentration of the glass fiber is in a range of 10% to 30%.

In addition to the die-cast zinc and aluminum materials and the mixture of POM resin and glass fiber, any other materials that may provide appropriate frictional force are also usable as a material of the door lever 120. In this case, the angle X° is appropriately changed based on friction coefficients of the respective materials, to allow the door to be opened by force applied from inside the door.

The door handle 140 is installed to be pushed by a user inserting his/her hand from the front side of the door 30. The door handle 140 is coupled to the door 30 via a door handle shaft 150. The door handle 140 includes a grip portion 141 to be pushed by the user, and a press portion 142 to press the handle contact portion 128 of the door lever 120.

Hereinafter, the opening principle of the door 30 by force applied to the door 30 according to the embodiment of the present invention will be described.

Figure 5:
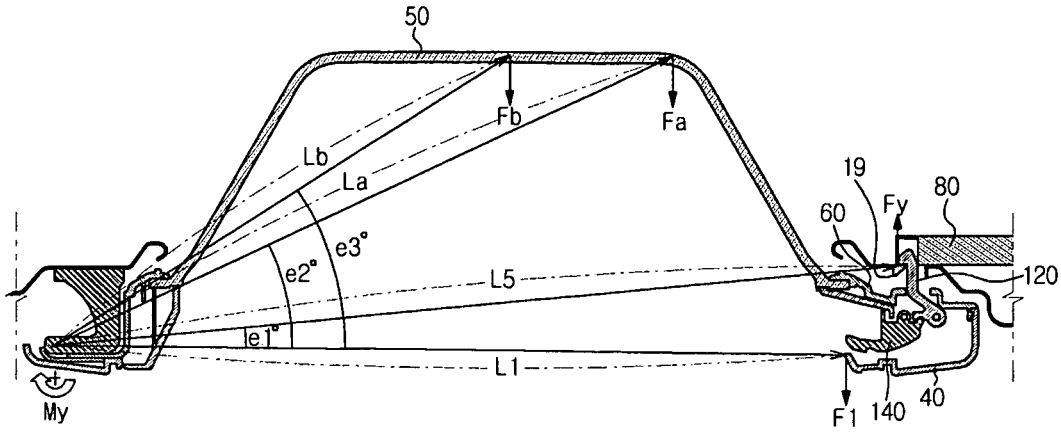
FIG. 5 is a detailed view illustrating action of force in FIG. 2.
Figure 6:
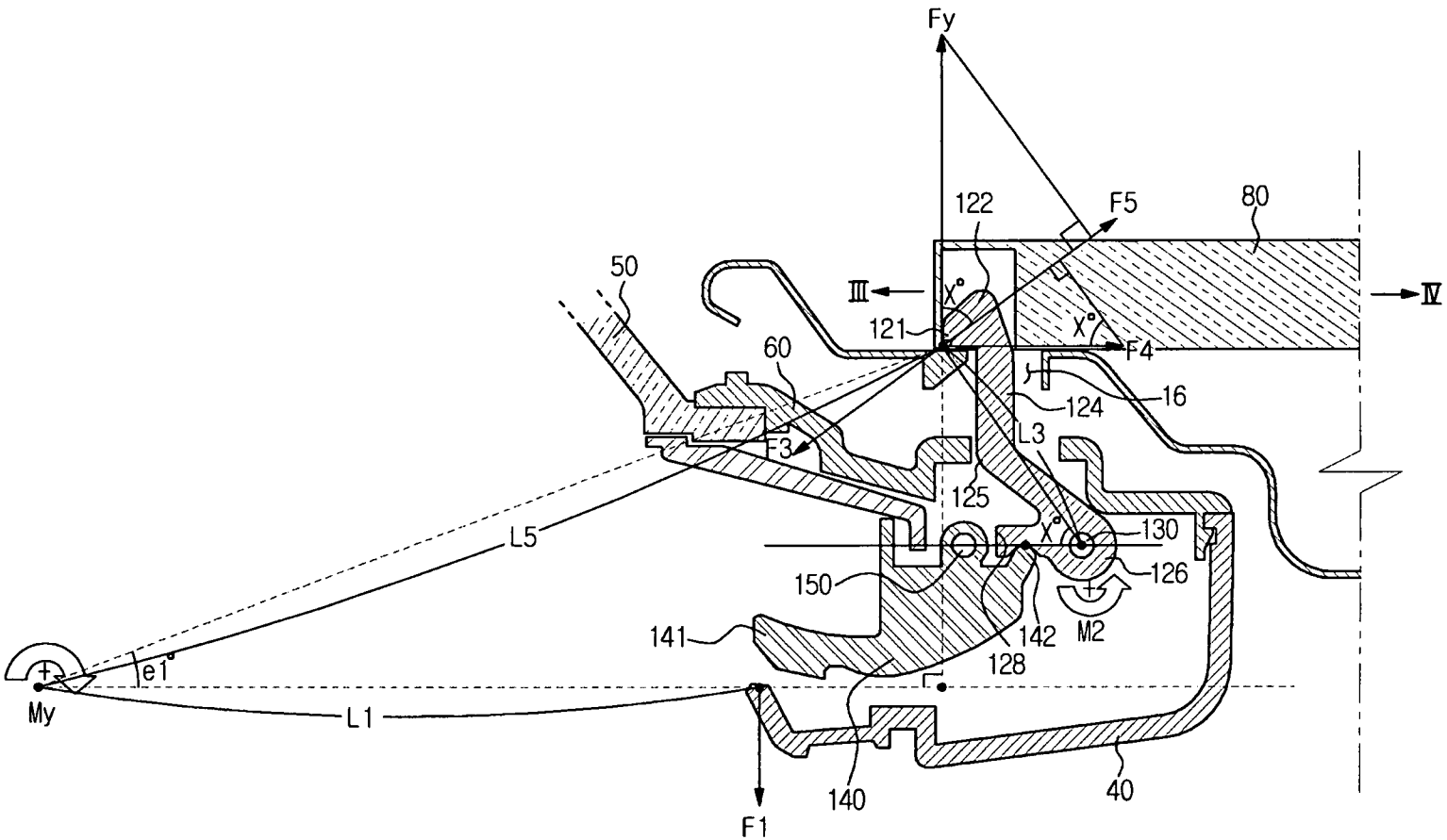
FIG. 6 is a detailed view illustrating action of force in FIG. 3.

FIG. 5 is a detailed view illustrating action of force in FIG. 2, and FIG. 6 is a detailed view illustrating action of force in FIG. 3.

Referring first to FIG. 5, force applied outward by a person who is locked inside the door 30 may be represented by Fa or Fb. This force may also be represented by a pulling force F1 that is a force to pull a distal (at a distance L1) end of the door cover 40 from the outside. Fa, Fb and F1 fulfill the following relation:

$$My=Fa*La*\cos(e2°)=Fb*Lb*\cos(e3°)=F1*L1 \quad (1)$$

where, My is rotation moment of the hinge shaft 18 of the door 30 La and Lb are moment arms, and e2 and e3 are angles, as shown in FIG. 5.

Then, the pulling force F1 may also be represented by force Fy that is a force to be applied to the end of the holding protrusion 21 based on the law of action and reaction. F1 and Fy fulfill the following relation:

$$F1*L1=Fy*L5*\cos(e1° \quad (2),$$

wherein L5 is the length of the moment arm.

Referring next to FIG. 6, elastic force, which is applied to the door lever 120 by the spring (not shown) installed at one side of the door lever 120, may be represented by rotation moment M2, and the following relation is obtained:

$$M2=F3*L3, \text{ i.e. } F3=(M2/L3) \quad (3),$$

wherein F3 is a force and L3 is the corresponding moment arm.

FIG. 6 illustrates a state wherein the door switch 80 is moved in a direction III and is closed. In the closed state thereof, the door switch 80 acts to continuously apply force F4 to the door lever 120 in a direction IV. If a sum of component forces Fy and F4 acting in an opposite direction of force F3 is F5, the following relation is obtained:

$$F5=Fy*\cos(X°)+F4*\sin(X°) \quad (4)$$

Finally, the door 30 is opened when the force F5 applied to the door lever 120 is greater than the force F3. That is, the following relation is obtained:

$$F5>F3 \quad (5)$$

By substituting F5 for the relation (4) and F3 for the relation (3) and summarizing them, we get)

$$Fy*\cos(X°)+F4*\sin(X°)>(M2/L3).$$

That is, $$Fy>\{(M2/L3)-F4*\sin(X°)\}/\cos(X°) \quad (6)$$

If Fy is greater than {(M2/L3)−F4*sin(X°)}/cos(X°), this means that the door 30 may be opened by the force Fa or Fb applied from inside the door 30.

By substituting exemplary design dimensions used in the embodiment (M2=6.6 kgf·cm, L3=3.18 cm, F4=0.4 kgf, and X°=55° for the relation (6), we get $$Fy>\{(6.6/3.18)-0.4*\sin(55°)\}/\cos(55°)=3.06 \text{ kgf.}$$

By substituting exemplary design dimensions of the embodiment (L5=42.1 cm, e1°=5.7°, and L1=39.0 cm) for the relation (2) in order to calculate the force applied from inside the door 30, we get $$F1>\{Fy*L5*\cos(e1°)\}/(L1)=\{3.06*42.1*\cos(5.7°)\}/(39.0)=3.3 \text{ kgf.}$$

By substituting exemplary design dimensions of the embodiment (La=33.6 cm, Lb=26.5 cm, e2°=26.5°, and e3°=34.5° for the relation (1), we get $$Fa>(F1*L1)/\{La*\cos(e2°)\}=(3.3*39.0)/\{33.6*\cos(26.5°)\}=4.3 \text{ kgf, and } Fb>(F1*L1)/\{Lb*\cos(e3°)\}=(3.3*39.0)/\{26.5*\cos(34.5°)\}=5.9 \text{ kgf.}$$

In summary, in the present embodiment, if the force Fa or Fb, applied from inside the closed door 30, is greater than 4.3 kgf or 5.9 kgf, the door lever 120 is separated from the door switch 80 even if the door handle 140 is not pushed from the outside, allowing the door 30 to be opened. This operation may be accomplished as a result of providing the door lever 120 with the bent portion 125 to create the angle X°.

Analyzing this in more detail using the relation (6), opening of the door 30 is accomplished under the assumption that the force Fy applied to the distal end of the holding protrusion 121 is greater than {(M2/L3)−F4*sin(X°)}/cos(X°). If the bent portion 125 is not provided, the angle X° is close to 90°. This means that, in the expression {(M2/L3)−F4*sin(X°)}/cos(X°), the value of)cos(X°) of the denominator is almost 0, and the value of) sin(X°) of the numerator is almost 1. That is, if the bent portion 125 is not provided, the value of the expression {(M2/L3)−F4*sin(X°)}/cos(X°) is close to infinity. This means that the door 30 may be opened only when the force Fy applied to the distal end of the holding protrusion 21 is infinitely great. If the force Fy is infinitely great, it will be appreciated from relations (1) and (2) that the door 30 may be opened when the force Fa or Fb applied from inside the door 30 is also infinitely great. In conclusion, if the bent portion 125 is not provided, the door 30 is not allowed to be opened even if a person who is locked in the rotating tub 20 applies force to the closed door 30, making it impossible for the person to escape the rotating tub 20.

However, in the present embodiment, as a result of the door lever 120 being formed with the bent portion 125 thus creating the predetermined angle X between the end of the holding protrusion 121, the center point 130*a* of the door lever shaft 130, and the contact point 128*a* between the handle contact portion 128 and door handle 140, the door 30 may be opened upon receiving the force Fa or Fb of the above-described magnitude or more applied from inside the door 30, allowing a person locked in the rotating tub 20 to escape through the opened door 30 and consequently, preventing an accident form occurring. Due to the above-described structural change of the door lever 120 according to the embodiment, a safe drum washing machine may be realized, in which the closed door 30 may be opened by force Fa or Fb of a predetermined magnitude or more applied from inside the door 30.

Although the above-described embodiment illustrates the angle X° of 55°, the angle X° may be in a range of 35° to 75°, to allow the door 30 to be opened by force of a predetermined magnitude or more applied from inside the door 30.

Also, although the above-described embodiment illustrates the case where the door 30 is opened by force applied from inside the door 30 in detail, the door 30 may also be opened by smaller force than in the related art even when the user attempts to open the door 30 from the outside by pushing the door handle 140.

This is accomplished based on the principle that the bent portion 125 increases a pivoting angle of the hook portion 122 when the user pushes the door handle 140 to open the door 30. That is, even if the user pushes the door handle 140 with smaller force thus causing the door handle 140 to be pivoted by a smaller angle, the bent portion 125 formed at the door lever 120 increases the pivoting angle of the hook portion 122, allowing the door 30 to be easily opened by smaller force.

As is apparent from the above description, in a drum washing machine according to the embodiment of the present invention, even if a door is unexpectedly closed, the door may be opened upon receiving force of a predetermined magnitude or more. This may prevent an accident from occurring when a person is locked in a rotating tub.

Although the embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A drum washing machine comprising:

a body having an opening;

a door to open or close the opening;

a door switch to lock the door; and a door lock device coupled to the door switch, wherein the door lock device includes a door lever pivotally installed to the door and selectively inserted into or separated from the door switch and a door handle in contact with the door lever, wherein the door lever includes a hook portion having a holding protrusion selectively caught by or released from the body, a rotating portion rotatably coupled to the door and having a rotation center, and a handle contact portion coming into contact with the door handle and a bent portion formed between the hook portion and the rotating portion to enable release of coupling between the door and the body by force of a predetermined magnitude or greater applied to the door, and wherein the holding protrusion extends from the hook portion in a first direction, the handle contact portion extends from the rotating portion in a second direction, and the bent portion is bent in a third direction between the first direction and the second direction while protruding toward a center of the door.

2. The drum washing machine according to claim 1, wherein the body comprises a raised portion, and wherein the holding portion is selectively caught by or released from the raised portion.

3. The drum washing machine according to claim 2, the door lever further includes a connecting portion to connect the hook portion and the rotating portion to each other, and the connecting portion includes a first connecting portion linearly extending from the hook portion to the bent portion, and a second connecting portion extending from the bent portion to the rotating portion, the second connecting portion being oblique relative to the first connecting portion.

4. The drum washing machine according to claim 3, wherein:

an angle defined between a contact point between the holding protrusion and the raised portion, the rotation center of the rotating portion, and a contact point between the handle contact portion and the door handle is between about 35° to about 75°.

5. The drum washing machine according to claim 1, wherein the door lever contains at least one of die-cast zinc and die-cast aluminum.

6. The drum washing machine according to claim 1, wherein the door lever is made of a mixture of PolyOxyMethylene (POM) resin and glass fiber.

7. The drum washing machine according to claim 6, wherein a concentration of the glass fiber in the mixture is in a range of about 10% to about 30%.

8. A door lock device of a drum washing machine, the door lock device comprising:

a door lever inserted into a body of the drum washing machine; and a door handle in contact with the door lever and rotatablv coupled to the door, wherein the door lever includes a hook portion having a holding protrusion selectively caught by or released from the body, a rotating portion rotatably coupled to the door and having a rotation center, and a handle contact portion coming into contact with the door handle and a bent portion formed at a position thereof to enable release of coupling between the door and the body by force of a predetermined magnitude or greater applied to the door, wherein the holding protrusion extends from the hook portion in a first direction, the handle contact portion extends from the rotating portion in a second direction, and the bent portion is bent in a third direction between the first direction and the second direction while protruding toward a center of the door, and wherein an angle defined between an end of the hook portion, the rotation center of the rotating portion, and a contact point between the handle contact portion and the door handle is between about 35° to about 75°.

9. The door lock device according to claim 8, wherein the door lever includes a connecting portion to connect the hook portion and the rotating portion to each other, and the connecting portion includes a bent portion.

10. The door lock device according to claim 9, wherein the connecting portion includes a first connecting portion linearly extending from the hook portion to the bent portion, and a second connecting portion extending from the bent portion to the rotating portion, the second connecting portion being oblique relative to the first connecting portion.

11. The door lock device according to claim 8, wherein the door lever contains at least one of die-cast zinc and die-cast aluminum.

12. The door lock device according to claim 8, wherein the door lever is made of a mixture of PolyOxyMethylene (POM) resin and glass fiber.

13. The door lock device according to claim 12, wherein a concentration of the glass fiber in the mixture between about 10% to about 30%.

14. The drum washing machine of claim 1, wherein a horizontal distance D1 between the holding protrusion and the rotation center of the rotating portion is larger than a horizontal distance D2 between one end of the handle contact portion and the rotation center.

15. A door lock device of a drum washing machine, the door lock device comprising:

a door lever inserted into a body of the drum washing machine; and a door handle in contact with the door lever, wherein the door lever includes a hook portion having a holding protrusion selectively caught by or released from the body, a rotating portion rotatably coupled to the door and having a rotation center, a handle contact portion coming into contact with the door handle and a connecting portion to connect the hook portion and rotating portion to each other, wherein an end of the hook portion and the rotation center of the rotating portion are spaced apart from each other at opposite sides of the connecting portion, to enable release of coupling between the door and the body by force of a predetermined magnitude or greater applied to the door, and wherein a horizontal distance D1 between the holding protrusion and the rotation center of the rotating portion is larger than a horizontal distance D2 between one end of the handle contact portion and the rotation center.

16. The door lock device according to claim 15, wherein the connecting portion includes a center bent portion, a first connecting portion extending from the hook portion to the bent portion, and a second connecting portion extending from the bent portion to the rotating portion.

17. The door lock device according to claim 16, wherein the door lever contains at least one of die-cast zinc and die-cast aluminum.

18. A door lock device of a drum washing machine, the door lock device comprising:

a door lever inserted into a body of the drum washing machine; and a door handle in contact with the door lever, wherein the door lever includes a hook portion having a holding protrusion selectively caught by or released from the body, a rotating portion rotatably coupled to the door and having a rotation center, a handle contact portion coming into contact with the door handle and a connecting portion to connect the hook portion and rotating portion to each other, wherein an end of the hook portion and the rotation center of the rotating portion are spaced apart from each other with a horizontal distance therebetween, to convert force applied to the door into force for release of coupling between the door and the body, and wherein a horizontal distance D1 between the holding protrusion and the rotation center of the rotating portion is larger than a horizontal distance D2 between one end of the handle contact portion and the rotation center.

19. The door lock device according to claim 18, wherein the connecting portion includes a center bent portion, a first connecting portion extending from the hook portion to the bent portion, and a second connecting portion extending from the bent portion to the rotating portion.

20. The door lock device according to claim 19, wherein the door lever contains at least one of die-cast zinc and die-cast aluminum.

* * * * *

UNITED STATES PATENT AND TRADEMARK OFFICE

CERTIFICATE OF CORRECTION

PATENT NO. : 8,661,859 B2
APPLICATION NO. : 12/662552
DATED : March 4, 2014
INVENTOR(S) : Choi It is certified that error appears in the above-identified patent and that said Letters Patent is hereby corrected as shown below:

In the Claims

Column 8, Line 45, In Claim 8, delete “rotatablv” and insert -- rotatably --, therefor.

Signed and Sealed this
First Day of July, 2014

Michelle K. Lee

Michelle K. Lee
*Deputy Director of the United States Patent and Trademark Office*